US005554999A

United States Patent [19]

Gupta et al.

[11] Patent Number: 5,554,999

[45] Date of Patent: Sep. 10, 1996

[54] COLLAPSIBLE FLAT ANTENNA REFLECTOR

[75] Inventors: Shyam Gupta, Pointe Claire; Ralph Pokuls, Beaconsfield, both of Canada

[73] Assignee: Spar Aerospace Limited, Mississauga, Canada

[21] Appl. No.: 189,799

[22] Filed: Feb. 1, 1994

[51] Int. Cl.[6] ..... H01Q 15/02

[52] U.S. Cl. ..... 343/909; 343/912; 343/915; 343/753

[58] Field of Search ..... 343/909, 912, 343/915, 767, 768, 770, 753, 797, 798, 803, 810, 812, 813

[56] References Cited

U.S. PATENT DOCUMENTS

| | | | |
|---|---|---|---|
| 3,373,434 | 3/1968 | Lorenzo et al. | 343/909 |
| 3,699,581 | 10/1972 | Hall et al. | 343/705 |
| 3,769,623 | 10/1973 | Fletcher et al. | 343/909 |
| 3,969,731 | 7/1976 | Jenkins et al. | 343/840 |
| 4,228,437 | 10/1980 | Shelton | 343/909 |
| 4,546,357 | 10/1985 | Laughon et al. | 343/702 |
| 4,684,954 | 8/1987 | Sureau et al. | 343/909 |
| 4,733,244 | 3/1988 | Edenhofer et al. | 343/909 |
| 4,905,014 | 2/1990 | Gonzalez et al. | 343/909 |
| 5,105,199 | 4/1992 | Ukmar | 343/792 |
| 5,132,699 | 7/1992 | Rupp et al. | 343/880 |
| 5,239,311 | 8/1993 | Arimura et al. | 343/770 |
| 5,357,260 | 10/1994 | Roederer et al. | 343/909 |

*Primary Examiner*—Hoanganh Le
*Attorney, Agent, or Firm*—Chilton, Alix & Van Kirk

[57] ABSTRACT

The reflector consists of a ground plane, enclosed in a ground plane frame, and a phasing plane, enclosed in a phasing plane frame. Spacers maintain the planes in connected, spaced relationship. The phasing plane includes a plurality of reactive elements sensitive to different frequencies in the bandwidth of the reflector. Thus, an E-M wave directed at the reflector is reflected to the angle of the received wave.

3 Claims, 4 Drawing Sheets

COLLAPSIBLE FLAT ANTENNA REFLECTOR

BACKGROUND OF INVENTION

1. Field of the Invention

The invention relates to a flat, collapsible antenna reflector which simulates the response of a three dimensional reflector. In one embodiment, the flat antenna reflector simulates a response of a normal parabolic reflector. The flat antenna reflector in accordance with the invention can also simulate other shaped reflectors.

The flat collapsible antenna reflector in accordance with the invention is especially adaptable for use on space capsules.

2. Description of Prior Art

Collapsible antennas are known in art as illustrated in, for example, U.S. Pat. No. 3,699,581, Hall et al, Oct. 17, 1972, U.S. Pat. No. 3,969,731, Jenkins et al, Jul. 13, 1976 and U.S. Pat. No. 5,132,699, Rupp et al, Jul. 21, 1992.

The '581 patent teaches a collapsible antenna arrangement for use in space. Foldable antennas are stowed in a cylindrical shroud during launch, and they are unfolded when the spacecraft body has been launched into space. As seen in FIG. 6, antenna elements 42 are arranged on one side of the panels. As disclosed at column 3, lines 31 and 32, these elements are arranged in a manner of a phased array.

The '731 patent teaches a mesh article useful as a reflector in space. The strands 2 of the mesh, as illustrated in FIG. 1, are covered by a conductive material 4 along their entire length.

The '699 patent was selected as of interest in its teachings of a collapsible antenna comprising a plurality of panels each of which panel is inflatable. As seen in FIG. 4, the panels comprise tubular elements 20 having disposed within them dipole elements 26.

SUMMARY OF INVENTION

It is an object of the invention to provide a novel flat collapsible antenna reflector.

It is a further object of the invention to provide such an antenna reflector which includes a ground plane and a spaced phasing plane.

It is a still further object of the invention to provide such an antenna reflector wherein the ground plane and the phasing plane are made of flexible materials whereby both planes are foldable so that the entire antenna reflector is collapsible.

In accordance with a particular embodiment of the invention there is provided a flat, collapsible, antenna reflector, for use in a predetermined bandwidth, and for reflecting an E-M wave, comprising:

a ground plane enclosed in a ground plane frame;

a phasing plane enclosed in a phasing plane frame;

spacer means for maintaining said planes in connected, spaced relationship;

said phasing plane including a plurality of reactive elements sensitive to different frequencies in said bandwidth;

whereby, to cause said E-M wave to be reflected at a predetermined angle to the angle of reception thereof.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
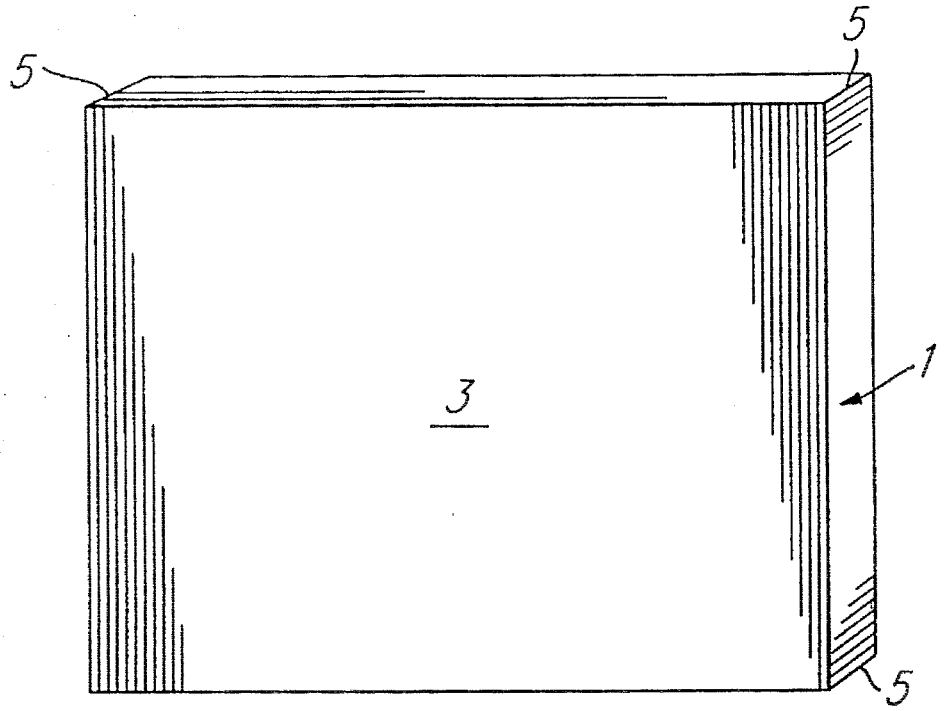
FIG. 1 illustrates generally the principles for forming a flat, collapsible, reflector antenna in accordance with the invention.

Referring to FIG. 1, it can be seen that the antenna reflector in accordance with the invention comprises a ground plane, illustrated generally at 1, and a phasing plane illustrated at 3. The planes are connected by spacers 5 which maintain the two planes in connected, but spaced, relationship.

Figure 2:
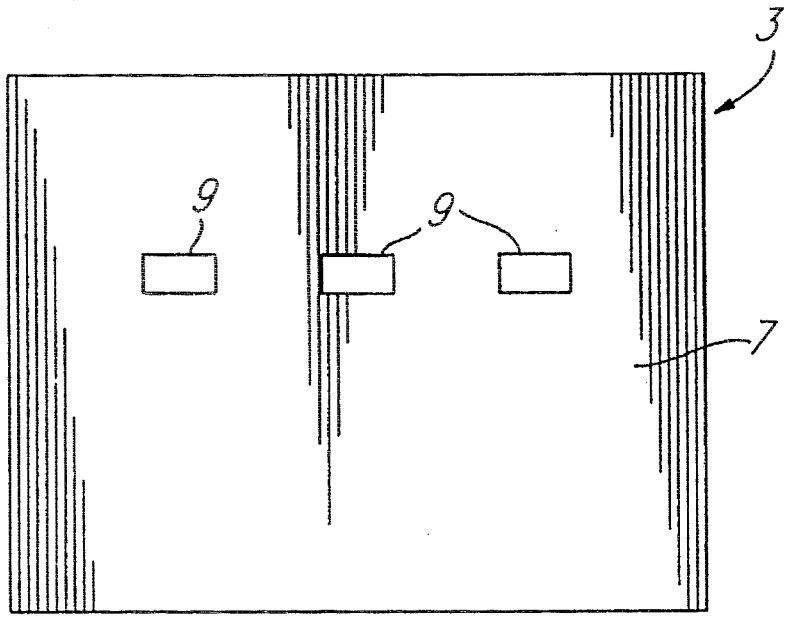
FIG. 2 illustrates a particular embodiment of a phasing plane in accordance with the invention.

Turning to FIG. 2, in one embodiment, the phasing plane 3 comprises a metallic sheet 7 having cut out slots 9. The slots form single or crossed dipoles. In accordance with the invention, the slots are of unequal size and may be unequally spaced from each other.

With a phasing plane as illustrated in FIG. 2, the ground plane can comprise a metallic sheet which would be of the same size as the metallic sheet 7 of FIG. 2.

Figure 3:
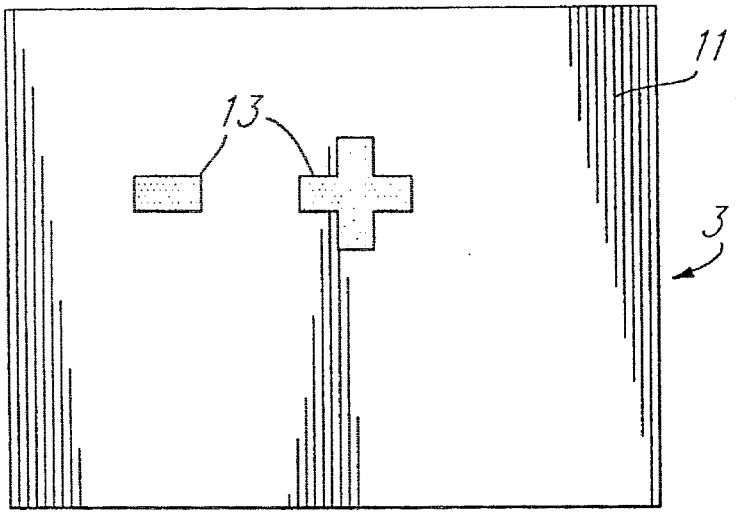
FIG. 3 illustrates a second embodiment of the phasing plane in accordance with the invention.

Turning now to FIG. 3, in another embodiment, the phasing plane comprises a dielectric sheet 11. Metallic patterns 13 are printed onto the dielectric sheet to form the dipoles. Once again, the painted on metallic patterns are of different size and of different spacing therebetween. In the embodiment of FIG. 3, the ground plane may also comprise a metallic sheet of the size as the dielectric sheet 11.

Figure 4:
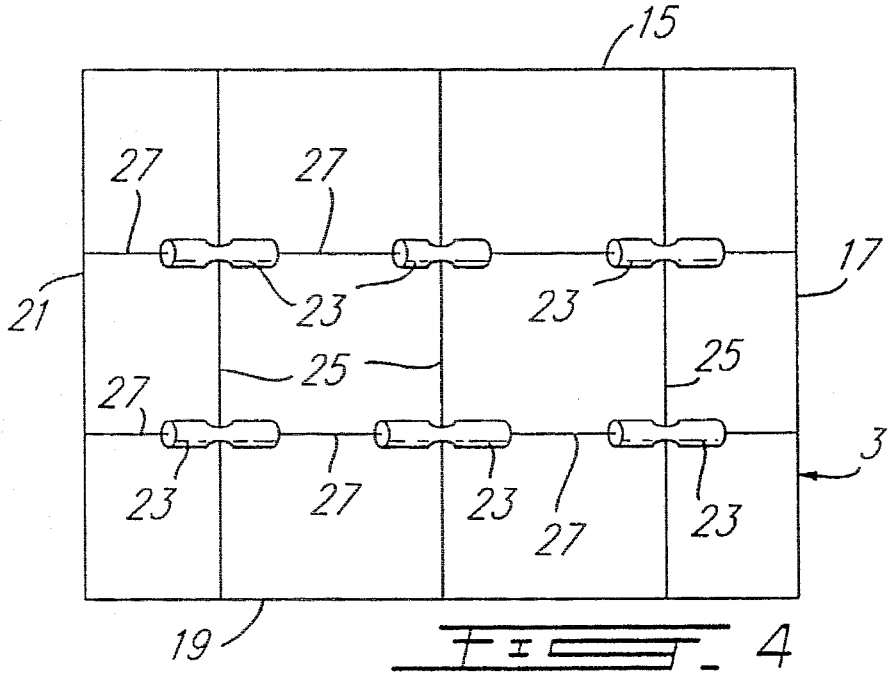
FIG. 4 illustrates a still further embodiment of a phasing plane in accordance with the invention.

In a further embodiment, illustrated in FIG. 4, the phasing plane comprise frame elements 15, 17, 19 and 21. The frame elements may be rigid members of, for example, a plastic material. Alternatively, they can be flexible members of, for example, a rope like material or the like.

The embodiments of FIGS. 2 and 3 are also enclosed by frame elements.

The frame elements enclose a plurality of different sized and differently spaced cylinders 23. The cylinders are made of a metallic material.

Figure 5:
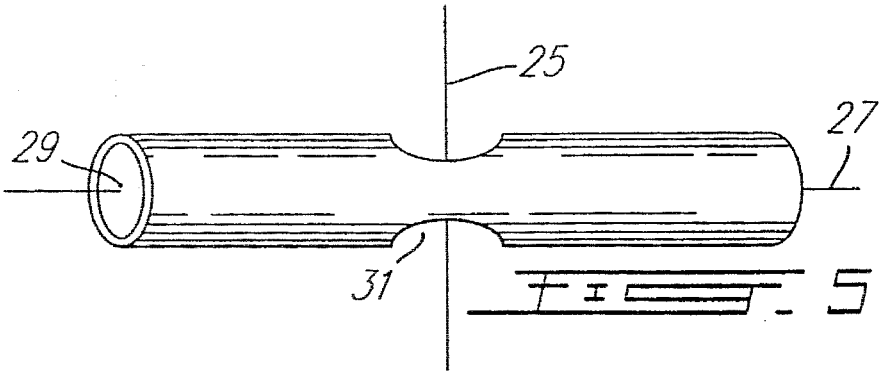
FIG. 5 shows in greater detail a cylinder used in the FIG. 4 embodiment.

As can be seen, the cylinders are strung along vertical strands 25 and horizontal strands 27. As seen in FIG. 5, each metallic cylinder 23 comprises a horizontal opening 29 extending along the axis of the cylinder, and a vertical opening 31 which extends transversely to the axis of the cylinder. As can be seen, the vertical strands 25 extend through the opening 31 and the horizontal strands 27 extend through the opening 29.

Figure 6:
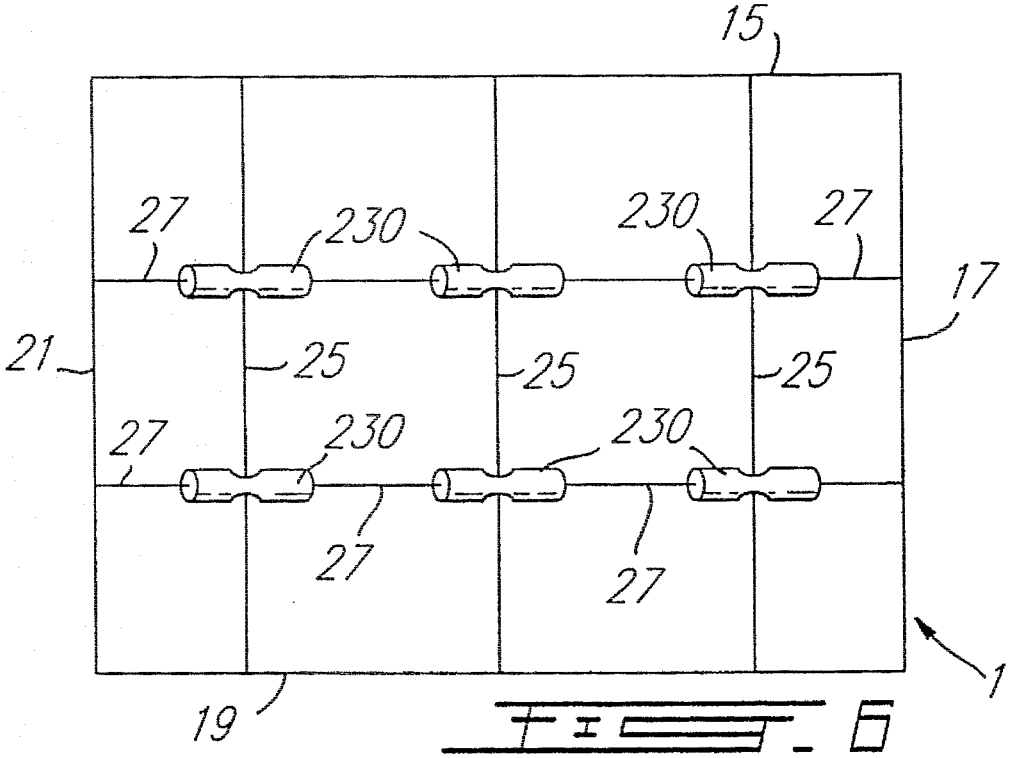
FIG. 6 illustrates a further embodiment of a ground plane using the cylinders of FIG. 5.

FIG. 6 illustrates an embodiment of the ground plane using metallic cylinders. In FIG. 6, the metallic cylinders 230 are all of equal size and there is equal spacing between the cylinders. Once again, the ground plane is enclosed by frame elements 15, 17, 19 and 21. The cylinders are strung by vertical strands 25 and horizontal strands 27.

Figure 7:
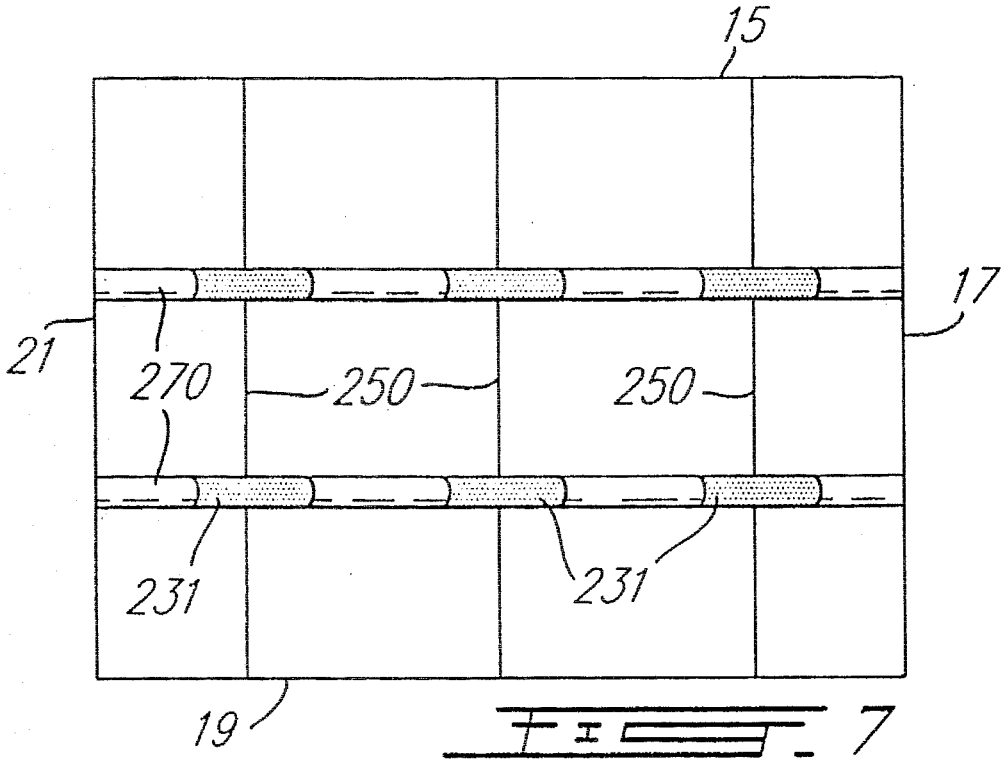
FIG. 7 illustrates a still further embodiment of a ground plane.

A further embodiment of a ground plane is illustrated in FIG. 7. In FIG. 7, the ground plane is also enclosed by frame elements 15, 17, 19 and 21. The ground plane is then made of vertical strands 250 and horizontal strands 270. The strands are made of a dielectric material, for example, kevlar. Cylinders 231 are painted onto the kevlar strands with a metallic paint. In the FIG. 7 embodiment, each of these cylinders is of equal size and is equally spaced from every other cylinder.

Figure 8:
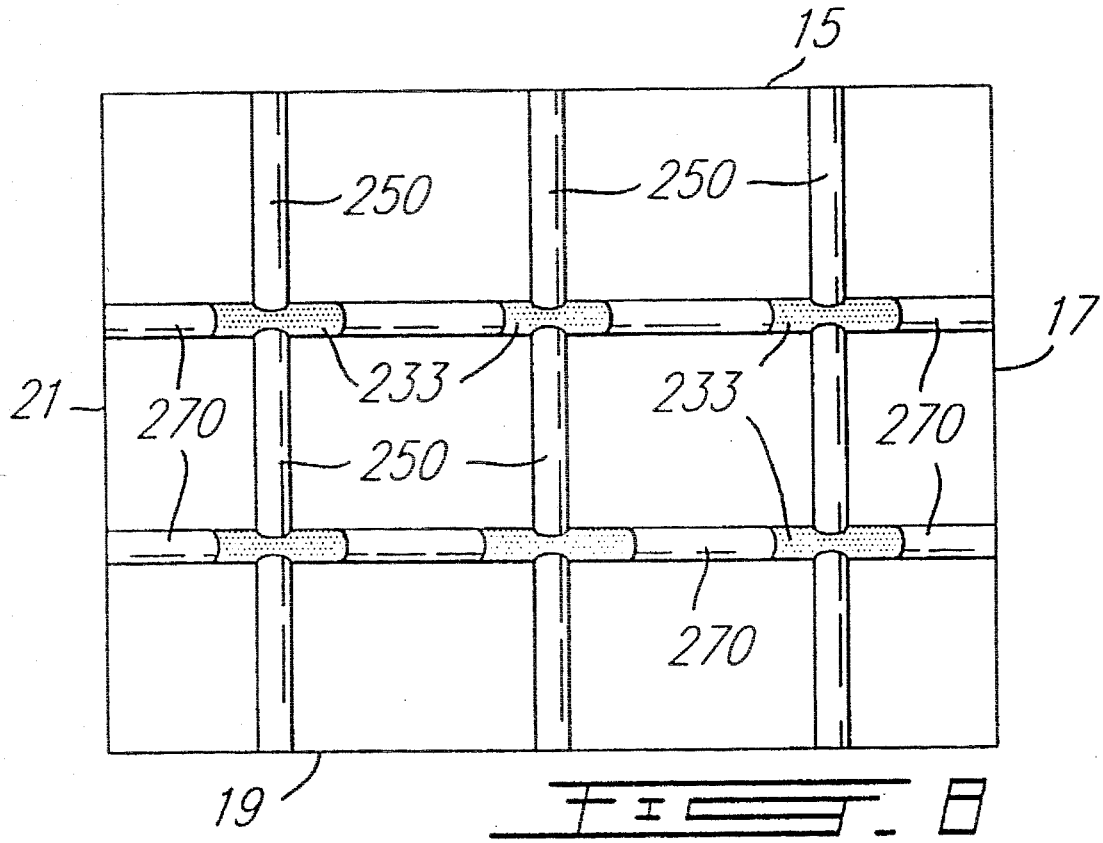
FIG. 8 illustrates a still further embodiment of a phasing plane.

A phasing plane which uses the same approach as FIG. 7 is illustrated in FIG. 8. In FIG. 8, once again, the frame elements 15, 17, 19 and 21 enclose the plane. The plane includes vertical strands 250 and horizontal strands 270. The strands are also of a dielectric material, for example, kevlar. Cylinders 233 are painted onto the strands with a metallic material. In the FIG. 8 embodiment, the cylinders are of an unequal size and are unequally spaced from each other.

On the phasing plane, the different approaches provide dipoles which, because of their unequal size and spacing, will have different reactions to an E-M wave of a given frequency. Thus, when an E-M wave of a given frequency is directed at the phasing plane, each dipole will cause it to reflect at a different angle, and the array of dipoles on the phasing plane of the reflector are adjusted to provide the proper phase relationships between the incident and reflected waves. The total reflected wave will constitute the sum of all of the reflected waves.

The dipoles on the ground plane are made to be resonant at the center frequency of the bandwidth of the antenna reflector.

Both the ground planes and the phasing planes, especially as shown in FIGS. 4–8, can be folded up in the manner of a window blind with horizontal slats.

Although several embodiments have been described, this was for the purpose of illustrating, but not limiting, the invention. Various modifications, which will come readily to the mind of one skilled in the art, are within the scope of the invention as defined in the appended claims.

We claim:

1. A flat, collapsible, antenna reflector for use in a predetermined bandwidth, said antenna reflector being configured to reflect a received E-M wave, said antenna reflector comprising:

a ground plane having a plurality of metallic cylinders attached to a ground plane frame by horizontal and vertical strands, said cylinders being of equal size and being equally spaced from each other;

a phasing plane having a plurality of metallic cylinders attached to a phasing plane frame by horizontal and vertical strands, said cylinders being of different sizes and with different spacing from each other; and spacer means for maintaining said planes in connected, spaced relationship;

wherein the vertical and horizontal strands in both of said ground plane and phasing plane comprise dielectric strands, said metallic cylinders of said phasing plane being sensitive to different frequencies in said band width to cause a received E-M wave to be reflected from said flat antenna reflector in a radiation pattern which simulates the response of a three-dimensional reflector.

2. An antenna reflector as defined in claim 1, wherein each metallic cylinder attached to both of said ground plane and phasing plane strands comprises a longitudinal axis;

a longitudinal opening extending along said longitudinal axis of each said cylinder; and a transverse opening extending transversely to said longitudinal axis of each said cylinder.

3. A flat, collapsible, antenna reflector for use in a predetermined bandwidth, said antenna reflector being configured to reflect a received E-M wave, said antenna reflector comprising:

a ground plane having a plurality of vertical and horizontal strands connected to a ground plane frame, said ground plane having dipoles comprising cylinders painted on said strands with a metallic paint, said cylinders of said ground plane being of equal size and spacing and being so disposed as to be resonant at the center frequency of the bandwidth of said antenna reflector;

a phasing plane having a plurality of horizontal and vertical strands connected to a phasing plane frame, said phasing plane having reactive elements comprising cylinders painted onto said vertical and horizontal strands with a metallic paint, said cylinders of said phasing plane being of different sizes and having different spacing; and spacer means for maintaining said planes in connected, spaced relationship;

wherein the vertical and horizontal strands in both said ground plane and said phasing plane comprise dielectric strands, said painted cylinders of said phasing plane being sensitive to different frequencies in said bandwidth to cause a received E-M wave to be reflected from said flat antenna reflector in a radiation pattern which simulates the response of a three-dimensional reflector.

* * * * *